US006662773B2

(12) United States Patent
Bauder

(10) Patent No.: US 6,662,773 B2
(45) Date of Patent: Dec. 16, 2003

(54) CYLINDER CRANKCASE FOR AN INTERNAL COMBUSTION ENGINE

(75) Inventor: Armin Bauder, Neckarsulm (DE)

(73) Assignee: Audi AG (DE)

( * ) Notice: Subject to any disclaimer, the term of this patent is extended or adjusted under 35 U.S.C. 154(b) by 0 days.

(21) Appl. No.: 10/296,505

(22) PCT Filed: Apr. 12, 2001

(86) PCT No.: PCT/EP01/04236

§ 371 (c)(1),
(2), (4) Date: Nov. 26, 2002

(87) PCT Pub. No.: WO01/91947

PCT Pub. Date: Dec. 6, 2001

(65) Prior Publication Data

US 2003/0116112 A1 Jun. 26, 2003

(51) Int. Cl.[7] ..... B22D 19/00
(52) U.S. Cl. ..... 123/193.2
(58) Field of Search ..... 123/193.2; 29/888.061

(56) References Cited

U.S. PATENT DOCUMENTS

| | | | | |
|---|---|---|---|---|
| 3,903,951 A | * | 9/1975 | Kaneko et al. | 123/193.2 |
| 4,546,048 A | | 10/1985 | Guenther | |
| 4,658,706 A | | 4/1987 | Sander et al. | |
| 4,936,270 A | * | 6/1990 | Ushio et al. | 123/193.2 |
| 5,047,185 A | | 9/1991 | Engel | |
| 5,829,405 A | * | 11/1998 | Godel | 123/193.2 |
| 6,318,330 B1 | * | 11/2001 | Kestner et al. | 123/193.2 |
| 6,354,259 B2 | * | 3/2002 | Fischer et al. | 123/193.2 |

FOREIGN PATENT DOCUMENTS

| | | |
|---|---|---|
| DE | 38 31 084 C2 | 10/1992 |
| DE | 43 10 491 A1 | 6/1994 |
| DE | 34 08 490 A1 | 9/1995 |
| EP | 0 292 040 A2 | 11/1988 |
| EP | 0 882 534 A1 | 12/1998 |
| JP | 08197229 | 6/1996 |

* cited by examiner

*Primary Examiner*—Marguerite McMahon
(74) *Attorney, Agent, or Firm*—Stevens, Davis, Miller & Mosher, LLP

(57) ABSTRACT

A cylinder crankcase for an internal combustion engine, the base body 1 of the engine consisting of a material A and the cylinder walls 2 of the engine of a second material B, and a lattice-like reinforcement 3 provided between the two materials A, B. A process for production of the cylinder crankcase such that the lattice-like reinforcement 3 is introduced into a casting mold for the cylinder crankcase, and that the two materials A, B are then introduced into the casting mold.

14 Claims, 2 Drawing Sheets

CYLINDER CRANKCASE FOR AN INTERNAL COMBUSTION ENGINE

This invention relates to a cylinder crankcase for an internal combustion engine, the basic structure consisting of a first material and the cylinder walls of a second material. The invention also relates to a process for production of a cylinder crankcase.

Integral casting or pressing of gray cast iron cylindrical bushings into cylinder crankcases of hypoeutectic aluminum in order to ensure the required wear resistance is of the state of the art. In integral casting or pressing of cylindrical bushings, however, the problem often arises that only an inadequate mechanical connection is established between the cylinder crankcase and the cylindrical bushings.

Also of the state of the art is maintenance of wear-resistant cylindrical bearing surfaces of hypereutectic aluminum in cylinder crankcases by uncovering embedded primary silicon particles. This, however, has the disadvantage that the cylindrical bearing surfaces have only an extremely thin wear-resistant coating, so that the most rigid requirements must be set for machining of the cylindrical bearing surfaces.

In addition, the publication DE 43 10 491 A1 discloses provision of at least partial bearing surface reinforcement for a lifting piston of an internal combustion engine consisting of an aluminum alloy. The reinforcement may be designed as a graphite layer with embedded metal particles bound by an artificial resin, thin adhesive-mounted metal foil, or an anchored metal plate.

SUMMARY OF THE INVENTION

Within this framework it is the object of the present invention to create a cylinder crankcase for an internal combustion engine which has an easily workable basic body and wear-resistant cylindrical bearing surfaces and is easy and cost-effective to produce. In addition, a process for manufacture of such a cylinder crankcase is to be provided.

The first object of the invention is attained in that a lattice-like reinforcement is provided between the two materials for the base body. As a result, these two materials can flow into each other in the area of the reinforcement in production of the cylinder crankcase, so that ideal anchoring of the second material for the cylinder walls in the first material for the base body is effected. At the same time, the lattice-like reinforcement keeps the first material of lower wear resistance for the base body from reaching the cylinder bearing surfaces subjected to heavy wear stress.

If the lattice-like reinforcement consists of a material with good thermal conductivity, a very good thermal flux between the two materials is also possible, as a result of which the thermal stress on the cylinder crankcase is substantially reduced and a longer service life is ensured.

It is advisable for the lattice-like reinforcement to be designed as wire gauze with a mesh size of approximately 0.1 to 1.0 millimeter. The precise value of the mesh size should be coordinated with the viscosities of the two materials so that the materials for the base housing and the cylinder walls can flow into each other through the meshes of the wire gauze when the materials are in the molten state.

It is particularly advisable for the lattice-like reinforcement to have larger openings on its side facing the base body than on that facing the cylinder walls. Hence the reinforcement is adapted to the preferred case, which is such that the material for the base body is of a lower viscosity when in the molten state than is the material for the cylinder walls.

In order that no casting problems will arise in production of the cylinder crankcase, the lattice-like reinforcement leaves the weblike areas between adjacent cylinder walls clear so that these weblike areas consist exclusively of the second material for the cylinder walls.

In addition, to prevent casting problems in production of the cylinder crankcase side cuts and/or casting nozzles for introduction of the second material for the cylinder walls are provided in the base body.

It is claimed for the process that the object is attained in that the lattice-like reinforcement is introduced into a mold for the cylinder crankcase in production of the cylinder crankcase, after which the two materials are introduced into the mold. Production of the cylinder crankcase can thus be carried out in a simple and cost-effective manner, since separate cylinder bushings need not be produced for this purpose and no costly machining of the cylinder bores is required.

If the two materials for the base body and the cylinder walls have distinctly different viscosities when in the molten state, the first material for the base body having a lower viscosity when in the molten state than that of the second material for the cylinder walls, the material for the base body is to be introduced into the mold first and then the material for the cylinder walls. Even in the case of a second material of especially high viscosity this procedure prevents this material from reaching the area of the base body through the reinforcement, since now only the cavities remaining in the mold for the cylinder walls have to be filled.

However, the two materials may, of course, also be introduced into the mold simultaneously, provided that their viscosities in the molten state do not differ too widely from each other.

It is claimed for another development of the proposed process that the second material for the cylinder walls is introduced into the casting mold under higher pressure. This makes certain that the wire gauze will not be forced against the wall of the mold, so that the wear resistance of the cylinder walls will not be impaired, and that the second material will completely fill the area between the base body and/or the wire gauze and the mold so that no air bubbles will remain in the latter.

BRIEF DESCRIPTION OF THE DRAWINGS

The invention is described in greater detail with reference to the following figures, of which

DETAILED DESCRIPTION OF THE INVENTION

Figure 1:
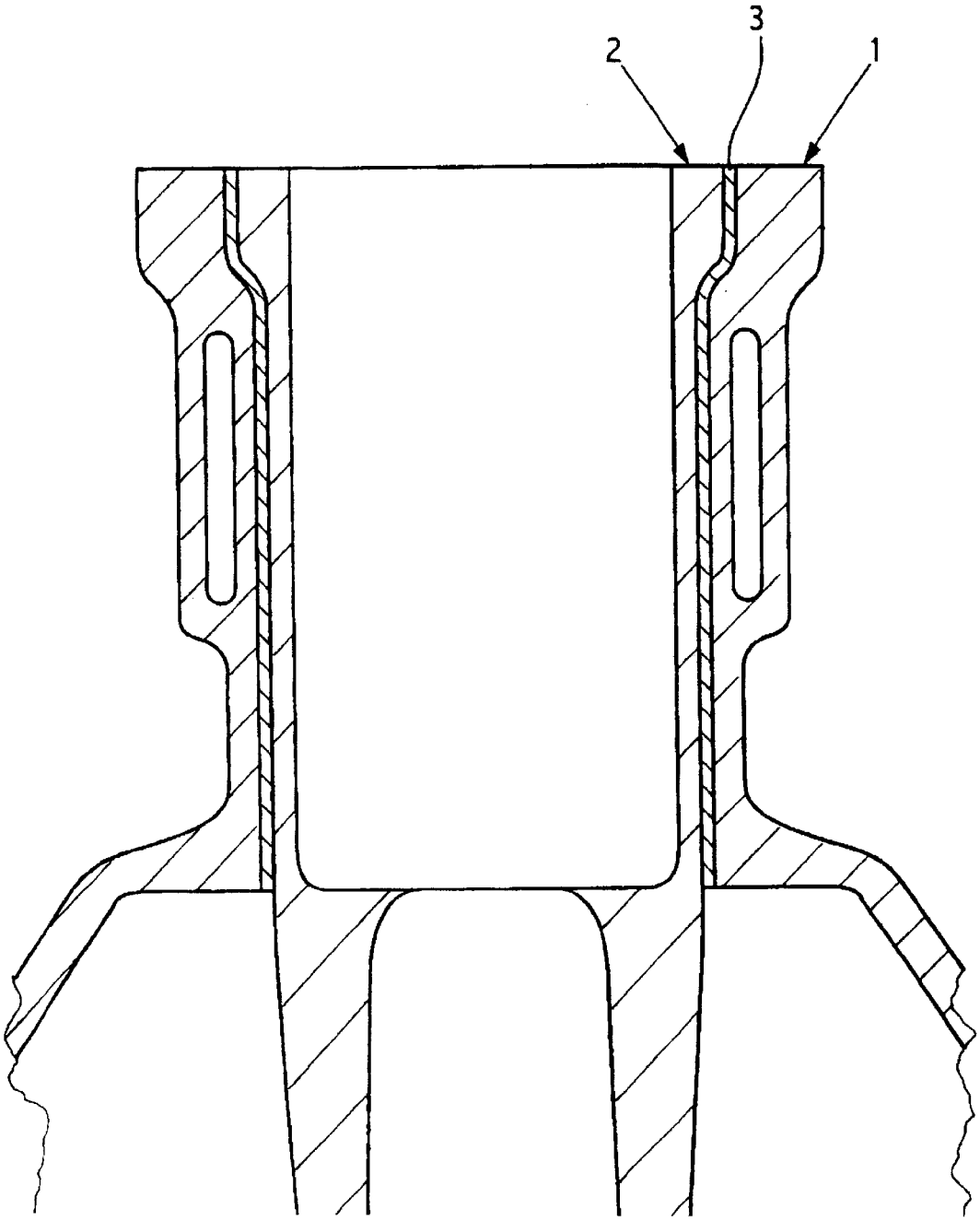
FIG. 1 shows a section through the cylinder crankcase claimed for the invention.
Figure 2:
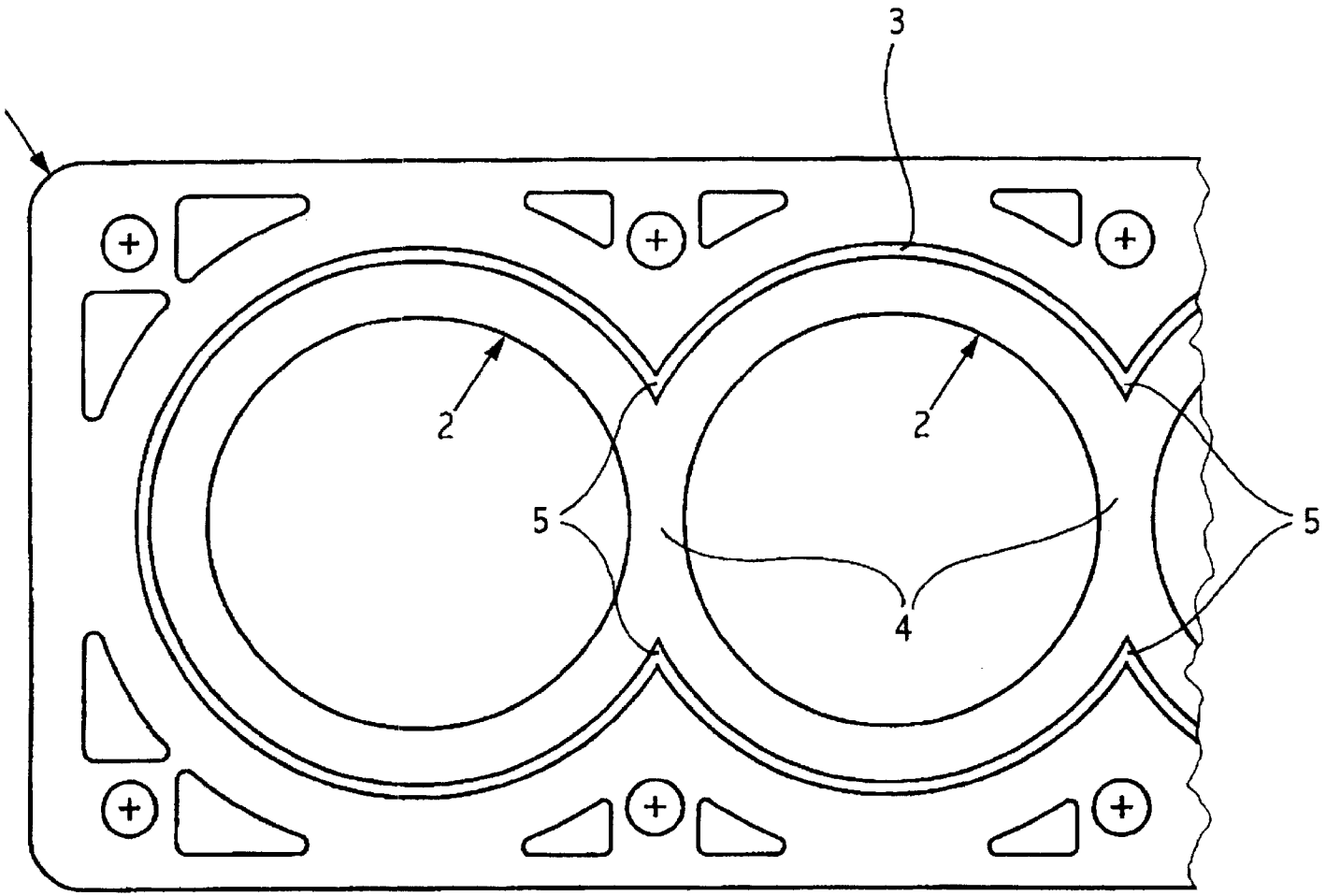
FIG. 2 a top view of the cylinder crankcase shown in FIG. 1.

The cylinder crankcase shown has a base body 1 of an easily workable first material A mounted in which body are cylinder walls 2 of a second material material B characterized by especially low wear. The first material A is a recast alloy having a first viscosity $V_A$ when in the molten state and the second material B is a hypereutectic aluminum alloy having a second viscosity $V_B$ when in the molten state, the first viscosity $V_A$ being lower than the second viscosity $V_B$.

The base body 1 and the cylinder walls 2 and the first material A and second material B respectively are separated from each other by means of a lattice-like reinforcement 3 of a fine-mesh wire gauze. The design of this wire gauze is such that takes into account the different viscosities $V_A$, $V_B$ of the two materials A, B, this wire gauze having larger openings on the side of the first material A for the base body 1 than on the side of the second material B for the cylinder walls 2. In addition, the wire gauze is shaped so that it leaves the weblike areas 4 between adjacent cylinder walls 2 clear and has only a dip 5 in these areas.

In order to make good heat transmission between the two materials A, B possible, the wire gauze consists of a material C characterized by good thermal conductivity, such as steel, and the two materials A, B merge free of air bubbles in the area of the lattice-like reinforcement 3.

For the purpose of producing the cylinder crankcase shown, first the lattice-like reinforcement 3 is introduced into a casting mold. The materials A, B for the base body 1 and the cylinder walls 2 are then introduced while in the molten state into the casting mold on the respective sides of the reinforcement 3. It is advantageous for the second material B for the cylinder walls 2 to be introduced into the casting mold with a slight delay and/or under slightly higher casting pressure, in order to achieve good merging of the two materials A, B. The first material A is introduced in the area of the thrust bearing walls of the base body 1 and the second material B by way of branch cuts and/or casting nozzles in the crankcase area of the base body 1.

What is claimed is:

1. A cylinder crankcase for an internal combustion engine having a base body consisting of a first material and cylinder walls of a second material, characterized in that a lattice-like reinforcement is provided between the two materials.

2. The cylinder crankcase as claimed in claim 1, wherein the lattice-like reinforcement consists of a material which is efficient from the viewpoint of thermal conduction.

3. The cylinder crankcase as claimed in claim 1, wherein the lattice-like reinforcement is designed as wire gauze with a mesh size of approximately 0.1 to 1.0 millimeter.

4. The cylinder crankcase as claimed in claim 1, wherein the lattice-like reinforcement is of a shape such that it has openings larger on the side facing the base body than those on the side facing the cylinder walls.

5. The cylinder crankcase as claimed in claim 1, wherein the lattice-like reinforcement leaves clear weblike areas between adjacent cylinder walls.

6. The cylinder crankcase as claimed in claim 1, wherein in the base body side cuts and/or casting nozzles are provided for introduction of the second material for the cylinder walls.

7. A process for production of a cylinder crankcase as claimed in claim 1, characterized in that the lattice-like reinforcement is introduced into a casting mold for the cylinder crankcase, after which the two materials are introduced into the casting mold.

8. The process as claimed in claim 7, wherein first the first material for the base body is introduced into the casting mold, and then, after a brief delay, the second material for the cylinder walls.

9. The process as claimed in claim 7, wherein the second material is introduced into the casting mold under slightly higher pressure.

10. The cylinder crankcase as claimed in claim 2, wherein the lattice-like reinforcement is designed as wire gauze with a mesh size of approximately 0.1 to 1.0 millimeter.

11. The cylinder crankcase as claimed in claim 10, wherein the lattice-like reinforcement is of a shape such that it has openings larger on the side facing the base body than those on the side facing the cylinder walls.

12. The cylinder crankcase as claimed in claim 11, wherein the lattice-like reinforcement leaves clear weblike areas between adjacent cylinder walls.

13. The cylinder crankcase as claimed in claim 12, wherein in the base body side cuts and/or casting nozzles are provided for introduction of the second material for the cylinder walls.

14. The process as claimed in claim 8, wherein the second material is introduced into the casting mold under slightly higher pressure.

* * * * *